US012247483B2

(12) United States Patent
Steele et al.

(10) Patent No.: US 12,247,483 B2
(45) Date of Patent: Mar. 11, 2025

(54) WIRE MESH FOR COMPLETION TOOLS

(71) Applicant: Halliburton Energy Services, Inc., Houston, TX (US)

(72) Inventors: David J. Steele, Carrollton, TX (US); Justin Roberts, Calgary (CA); Dara Saphira, Carrollton, TX (US); Esiquiel Marquez, Carrollton, TX (US); Thomas Charles Fanchin, Spring, TX (US); Mark Christopher Glaser, Spring, TX (US); Brian W. Cho, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/129,046

(22) Filed: Mar. 30, 2023

(65) Prior Publication Data

US 2024/0328310 A1 Oct. 3, 2024

(51) Int. Cl.

| | |
|---|---|
| ***E21B 47/16*** | (2006.01) |
| ***E21B 17/00*** | (2006.01) |
| ***E21B 23/06*** | (2006.01) |
| ***E21B 47/125*** | (2012.01) |

(52) U.S. Cl.

CPC ..... *E21B 47/16* (2013.01); *E21B 17/003* (2013.01); *E21B 23/06* (2013.01); *E21B 47/125* (2020.05)

(58) Field of Classification Search

CPC ..... E21B 47/16; E21B 17/003; E21B 23/06; E21B 47/125

See application file for complete search history.

(56) References Cited

U.S. PATENT DOCUMENTS

| | | | | |
|---|---|---|---|---|
| 8,122,958 | B2 | 2/2012 | Vestavik | |
| 8,833,489 | B2 | 9/2014 | Hogset et al. | |
| 2002/0075114 | A1* | 6/2002 | Hall | F16L 25/01 336/192 |
| 2005/0284664 | A1 | 12/2005 | Riel et al. | |
| 2010/0149056 | A1 | 6/2010 | Contant et al. | |
| 2010/0314107 | A1 | 12/2010 | Vestavik | |
| 2013/0265171 | A1 | 10/2013 | Hay | |
| 2015/0009040 | A1 | 1/2015 | Bowles et al. | |
| 2017/0067336 | A1 | 3/2017 | Turner | |
| 2020/0392838 | A1* | 12/2020 | Livescu | E21B 47/135 |
| 2021/0175382 | A1* | 6/2021 | Chabrecek | H01L 31/0512 |
| 2022/0074286 | A1* | 3/2022 | Lonnes | E21B 17/08 |
| 2022/0148761 | A1* | 5/2022 | Crane | F04D 13/10 |
| 2022/0178211 | A1 | 6/2022 | Steele et al. | |
| 2022/0195842 | A1* | 6/2022 | Werkheiser | E21B 23/04 |
| 2023/0167692 | A1* | 6/2023 | Al-Mousa | E21B 33/0385 166/250.15 |

FOREIGN PATENT DOCUMENTS

WO 2018126326 A1 7/2018

OTHER PUBLICATIONS

International Search Report and Written Opinion in PCT/US2023/017210 mailed Dec. 20, 2023.

* cited by examiner

*Primary Examiner* — Amine Benlagsir
(74) *Attorney, Agent, or Firm* — The Hilton Firm PLLC

(57) ABSTRACT

Apparatus and methods for transmitting an electrical signal in a wellbore. A tool comprising a wire mesh is introduced into a wellbore. The wire mesh is disposed along at least a portion of the axial length of the tool. An electrical signal is transmitted along the wire mesh to or from a wellbore device disposed in the wellbore.

20 Claims, 13 Drawing Sheets

WIRE MESH FOR COMPLETION TOOLS

TECHNICAL FIELD

The present disclosure relates generally to wellbore operations, and more particularly, to the use of wire mesh to enable the transfer of signals and energy along wellbore tools during completion or other phases of well development as well as built into the final well completion systems.

BACKGROUND

In a wellbore, it may be desirable to conduct an electrical signal downhole to actuate wellbore devices, collect data, adjust parameters of wellbore equipment, and the like. Some wellbore equipment, such as completion equipment, may have a very large outer diameter. This outer diameter is a larger diameter than other types of wellbore equipment, such as that of a drill string. Because of the enlarged diameter, the available annular space is reduced thereby making it difficult or impossible to run conventional control lines along the exterior or the interior of the completion tool. The limited annular space increases the risk of damage to the control lines from abrasion or other contact with surfaces adjacent to the exterior of the completion tool, such as a wall of a wellbore. Shielding the control lines by sheathes or other covering systems may increase the overall size of the typical control line which may not be possible with the limited annular space.

The transference of signals, sensor data, operational parameters, actuation instructions, and power in one or more directions as well as bi-directionally is an important part of a completion operation as well as the long-term monitoring and control of well performance. The present invention provides improved apparatus and methods for transferring signals and energy through well completion systems during completion and other well operations.

BRIEF DESCRIPTION OF THE DRAWINGS

Illustrative examples of the present disclosure are described in detail below with reference to the attached drawing figures, which are incorporated by reference herein, and wherein.

Figure 1:
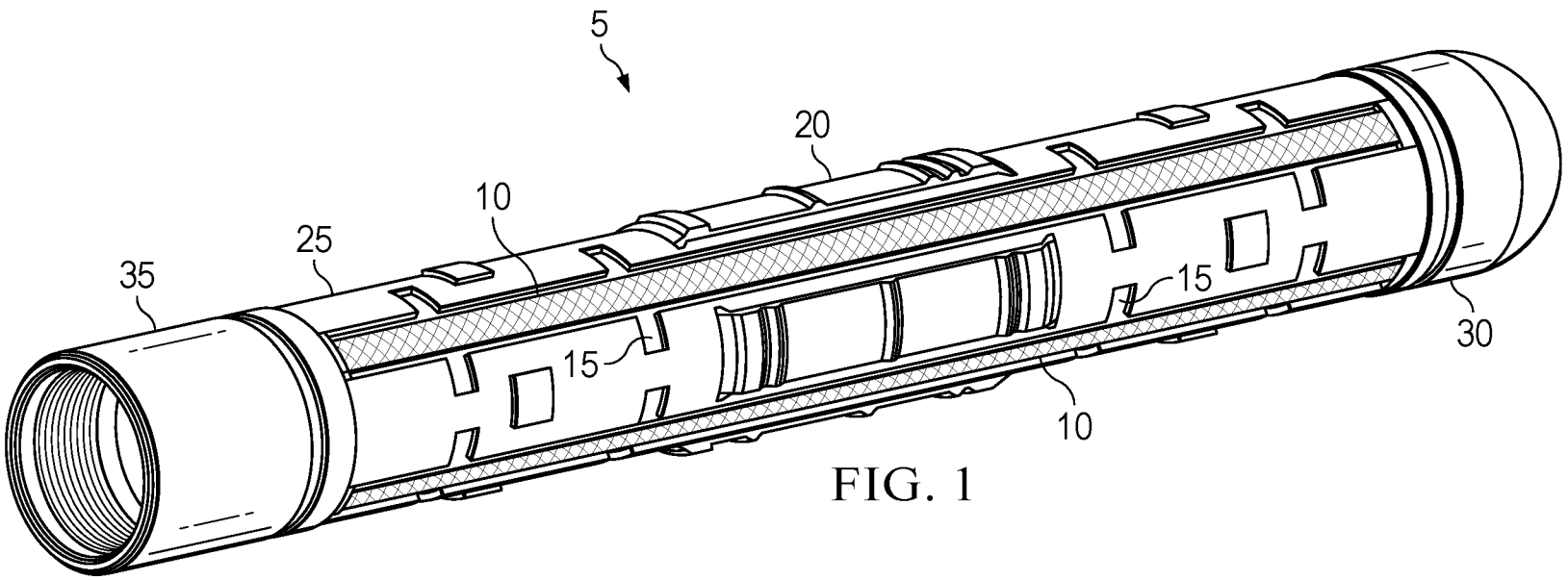
FIG. 1 is a perspective drawing illustrating an example of a latch assembly with a wire mesh in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of wire mesh to enable the transfer of energy and signals throughout the well completion system and during completion and other well operations.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The present disclosure relates generally to wellbore operations, and more particularly, to the use of wire mesh to enable the transfer of signals through completion systems and during completion operations. The completion tools are constructed to possess a wire mesh disposed along at least a portion of the length of the completion tool. The wire mesh is a conductor that is configured to transmit an electrical signal along the portion of the length of the completion tool. As used herein, a "completion tool" and all variants thereof, refers to a wellbore tool used during the completion phase of well construction. The completion phase comprises operations to complete the wellbore and also includes all workover operations. Additionally, the wire mesh and methods described herein may remain in the well to operate and monitor wellbore equipment and systems during other wellbore phases or operations such as production or stimulation.

As used herein, a "workover operation" refers to any operation done on, within, or through the wellbore after the initial completion. Although proper drilling, cementing, and completion practices may minimize the need for workover operations, it is common for wells to need workovers during their lifetime. Workovers may be divided into (1) jobs performed primarily to influence the reservoir and (2) jobs applied to the wellbore (including the cement) and its associated equipment. Workovers done primarily to influence the reservoir can be subdivided into (1) work done for the zone already open and (2) work done to shut off the existing zone in favor of opening a new zone, which may be called a recompletion. Examples of a workover operation may include, but are not limited to stimulation (such as acidizing, fracturing, scale, or paraffin treatment), reperforating, perforating additional intervals, squeeze cementing, fishing, setting plugs (cement or mechanical), retrieving production equipment, cutting and pulling casing, and plugging off unwanted perforations. Some workover operations may include casing or equipment repair, cleaning out fill over the producing zone, or circulating chemical treatments (such as in scale or paraffin removal operations). Some workover operations involve the installation, maintenance, repair or replacement of wellbore equipment installation, maintenance, and repair of wellbore equipment including, but not limited to, cement, tubulars, packers, wireline components, safety valves, or artificial lift equipment in the wellbore. Workover operations may utilize conventional rigs or nonconventional systems such as wireline units, coiled tubing units, and snubbing units.

Advantageously, the wire mesh is electrically coupled to a wellbore device such as a sensor, valve, casing equipment, an inductive coupling, a packer, and the like. As used herein, a "wellbore device" and all variants thereof, refers to a device used within a wellbore. The wellbore device may be located uphole, downhole, or disposed on the completion tool. The wire mesh allows for the transmission of an electrical signal during completion operations in which it would be risky or impossible to place a control line on the exterior of the completion tool and/or the wellbore device. The wire mesh possesses a cross-section smaller than that of typical control lines. The wire mesh is thus able to be placed in much smaller spaces as it can be made flatter and thinner than a control line. Despite being less thick than traditional control lines, the mesh is made to extend in a wider area, thereby increasing the overall conductive area even though it is much thinner than traditional control lines. As such, surface contact via electrical transmission with the wellbore device is possible as the wire mesh operates along the length of the completion tool despite the limited annular space. The wire mesh may comprise any type of conductor material sufficient for electrical transmission. Examples of these materials may include, but are not limited to, copper, aluminum, cadmium and copper alloys, phosphor bronze, galvanized steel, steel core copper, steel core aluminum, alloys, tungsten, nanomaterials, carbon nanomaterials, nanotubes, graphene, or any combination of materials. The mesh weave may comprise any type of weave sufficient for electrical transmission. Examples of the weaves include, but are not limited to, plain weaves, twill weaves, Dutch weaves, plain Dutch weaves, twill Dutch weaves, reverse Dutch weaves, multiplex weaves, or any combination of weaves.

The wire mesh may be produced using any suitable method for the desired application. Some examples of the wire mesh utilize ultraviolet lithography technology to produce a wire mesh having a thickness of about 3 nm (nanometers) to about 38 nm. In other examples, ultraviolet lithography systems using argon-fluoride (ArF) excimer lasers may be used to produce a wire mesh having a thickness of about 38 nm to about 80 nm. Additional examples may use krypton-fluoride (KrF) lasers to produce a wire mesh having a thickness of about 80 nm to about 280 nm. Still other examples of making the wire mesh may include but are not limited to micromachining, photo-chemically etched, acid etched, or a combination if techniques. In these examples, the wire mesh may have a thickness of about 80 nm to about 100 μm (micrometer). Mechanical manufacturing techniques may be employed in some examples including, but not limited to, drawing (including wire-drawing, continuous wire-drawing, roll drawing, etc.), swaging, extrusion, pultrusion, or a combination of techniques. In these examples, the wire mesh may have a thickness of about 100 μm (0.1 mm) to about 25.4 mm. In examples where the wellbore has a very large diameter, a wire mesh having a thickness greater than 25.4 mm may be used. The thickness of the wire mesh will vary per the type of completion tool and the location of the wire mesh along the completion tool. The thickness of the wire mesh is smaller than the length or width of the wire mesh. In some examples, the width of the wire mesh may about twice as wide as the thickness of the wire mesh to about 614 times as wide as the thickness of the wire mesh. For example, for a standard 4½" outer diameter tubular, the width of the wire mesh may be 117 times as wide as the thickness of the wire mesh. For a standard 24" outer diameter, the width of the wire mesh may be 624 times as wide as the thickness of the wire mesh. The width to thickness ratio may range from about 2 to about 2,662. The length of the wire mesh may extend, in some examples, from the surface to the wellbore device. In other examples, the wire mesh may descend from a desired point uphole of the wellbore device instead of from the surface. In some examples, the length of the wire mesh may be divided into truncated sections that are joined together via connectors.

The wire mesh may comprise one or more electrically insulating features. For example, the individual strands of the wire mesh may each be electrically insulated. In some examples, the entire wire mesh may be coated in an insulating material. Alternatively, in other examples, only portions of the wire mesh may be coated in an insulating material.

The wire mesh is strong enough to support its own weight. In some examples, the weave of the wire mesh may comprise nonconductive fibers in addition to the conductive fibers. The nonconductive fibers may have larger diameters than the conductive fibers. The nonconductive fibers may be used to support the wire mesh so that the wire mesh is able to support its own weight. The nonconductive fibers may be formed from different materials than the conductive fibers and these different materials may be stronger and more rigid than the conductive materials of the conductive fibers. For example, the nonconductive fibers may comprise a carbon fiber material. In some examples, the wire mesh may comprise multiple layers. The multiple layers may overlap completely or partially. In some examples, the additional layers may be used to increase the overall strength of the wire mesh.

In some examples, the wire mesh may be disposed on the exterior of the completion tool. The wire mesh may be positioned in a groove, slot, relief, and the like on the exterior of the completion tool. In some examples, the wire mesh may be positioned within an enclosure that is strapped, bolted, or otherwise affixed to the exterior of the completion tool. The enclosure may prevent the wire mesh from contact with other surfaces or fluids within the wellbore. In some examples, the wire mesh may itself be strapped, bolted, glued, wrapped, or otherwise affixed to the exterior of the completion tool. Additionally, any combination of these methods for affixing the wire mesh to the completion tool may be used.

In some examples, the wire mesh may be disposed in a void within the interior of the completion tool. For example, the wire mesh may be positioned along a portion of the surface of the interior of the completion tool. The wire mesh may be positioned in a groove, slot, relief, and the like on the interior of the completion tool. In some examples, the wire mesh may be positioned within an enclosure that is strapped, bolted, or otherwise affixed to the interior of the completion tool. The enclosure may prevent the wire mesh from contact with other surfaces or fluids within the completion tool. In some examples, the wire mesh may itself be strapped, bolted, glued, wrapped, or otherwise affixed to the interior of the completion tool. Additionally, any combination of these methods for affixing the wire mesh to the completion tool may be used.

In some examples, the wire mesh may be disposed between an inner and outer wall of the completion tool. The completion tool may comprise a housing having an outer wall and an inner wall with a void space existing between the inner wall and the outer wall. The wire mesh may be positioned within that void space. The void space may comprise a groove, slot, relief, or the like. In some examples, the completion tool may comprise multiple void spaces with the wire mesh running through one or more of the void spaces. The multiple void spaces may be disposed between the same or different portions of an inner and outer wall, or may be disposed between different inner and outer walls. In some examples, the wire mesh may be positioned within an enclosure that is strapped, bolted, or otherwise affixed to one or both of the inner wall or the outer wall. In some examples, the wire mesh may itself be strapped, bolted, glued, wrapped, or otherwise affixed to one or both of the inner wall or the outer wall. Additionally, any combination of these methods for affixing the wire mesh to the completion tool may be used.

In some examples, the wire mesh may transition from the interior of the completion tool to a void space within an inner and outer wall of the completion tool and vice versa. Similarly, the wire mesh may transition from the interior of the completion tool to the exterior of the completion tool and vice versa. In further examples, the wire mesh may transition from a void space within an inner and outer wall of the completion tool to the exterior of the completion tool and vice versa. In the examples where the wire mesh transitions to another area of the completion tool, an optional pressure barrier may be used to prevent alteration of the pressure differential at the transition point of the wire mesh. Likewise, optional seals may be placed at the transition point to prevent the leakage of fluids across the transition point.

FIG. 1 is a perspective drawing illustrating an example completion tool, a latch assembly 5. In some examples, latch assembly 5 may be a subassembly of a variety of completion tools such as completion deflectors, milling machines, whipstocks, packers, etc. Latch assembly 5 may be mated with a latch coupling during a completion operation such as a milling or deflection operation. The latch assembly 5 comprises a wire mesh 10 disposed in an axial groove (obscured by the wire mesh) running in the axial direction along the exterior of the latch assembly 5. The exterior of the latch assembly 5 further comprises lateral grooves 15 adjacent to the wire mesh 10 and dispersed at intervals along the axial groove. The lateral grooves 15 may be used to hold straps, plates, or other restraining mechanisms to hold the wire mesh 10 in position in the axial groove. Alternatively, the wire mesh 10 may be affixed directly to the exterior of the latch assembly 5 via bolts, welds, adhesives, and the like. In such an example, the lateral grooves 15 are optional and may not be present if desired. The latch assembly 5 further comprises locating keys 20 which orient the latch assembly 5 into a latch coupling as described below. The latch assembly 5 further comprises a housing 25 and a guide shoe 30. A top subassembly 35 is used to electrically couple the wire mesh 10 to equipment uphole. Although the latch assembly 5 is illustrated as having the wire mesh 5 disposed on the exterior, it is to be understood that the wire mesh 5 may be disposed on the interior of the latch assembly 5 and/or within a void space between an inner and outer wall of the housing 25.

Figure 2:
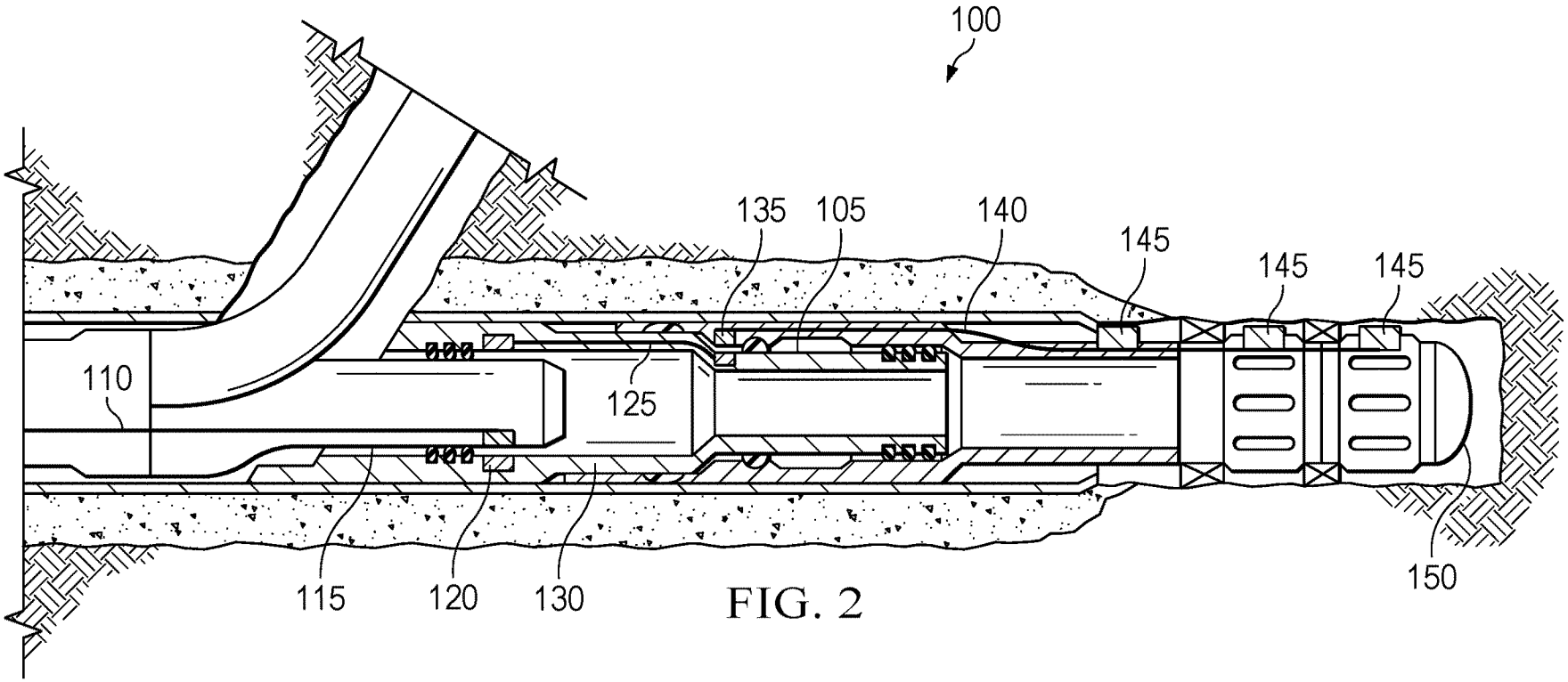
FIG. 2 is a cross-section drawing illustrating an example deflector with a latch assembly and wire mesh in accordance with one or more examples described herein.

FIG. 2 is a cross-section drawing illustrating an example completion tool, a deflector 100 having a latch assembly 105. The completion deflector 100 is used for a multi-lateral completion operation. A wire mesh portion 110 is run on the exterior of a short string 115. The short string 115 may also be referred to as a junction leg or mainbore leg as this leg remains in the main bore of the well. The wire mesh portion 110 descends from uphole and in some examples may connect to the surface. An energy transfer mechanism 120 electrically connects the wire mesh portion 110 with the wire mesh portion 125 thereby allowing the wire mesh portions (110, 125, and 140) to transition the energy/signal to another wire mesh or portion of the wire mesh. This transition may transfer the energy/signal to a different location on the length of the completion tool and/or to allow the energy/signal to transition from a wire mesh to a wire mesh disposed on a different completion tool or wellbore device. The transition of the electrical energy/signal by the energy transfer mechanism 120 may be via a physical contact or a non-contact means. Energy transfer mechanism 120 may be a wet connect, an inductive coupling, a dry-mate connector (e.g., a dual-seal dry-mate connector), capacitance coupling, radiofrequency waves, or any other such energy transfer mechanism sufficient for electrically coupling wire mesh portion 110 with wire mesh portion 125. As used herein, an "electrical connection" and use of the term "electrically connects" and all variants thereof, includes non-contact means and non-direct connections, for example, those that use electromagnetic fields such as inductive coupling to convey the energy/signal across different sections of the wire mesh while not physically connected.

Wire mesh portion 125 extends within a void space between an inner and outer wall of the housing 130 of the completion deflector 100. Wire mesh portion 125 runs through this portion of the housing 130 and connects to energy transfer mechanism 135. Energy transfer mechanism 135 electrically connects wire mesh portion 125 to wire mesh portion 140. Energy transfer mechanism 135 may be the same or a different type of energy transfer mechanism as energy transfer mechanism 120. Wire mesh portion 140 runs along an exterior portion of the completion deflector 100 and connects to wellbore devices 145, such as valves and/or sensors disposed on the guide shoe 150 as well as areas wherein gas, oil, and water may be produced, controlled, and/or regulated. The wellbore devices 145 are now electrically connected to the short string 115 via wire mesh portions 110, 125, and 140 and an electrical signal may be transmitted to the wellbore devices 145 from a location uphole of the short string 115. The series of wire mesh portions 110, 125, and 140 may be used to actuate the wellbore devices 145, provide instructions to the wellbore devices 145, and/or to convey information to/from the wellbore devices 145. In some examples, the short leg 115 may be longer and may extend further downhole. In these examples, only one energy transfer mechanism 120 would be necessary. This reduced complexity may make the system more reliable as it may use less energy transfer mechanisms 120 and less wire mesh.

In other embodiments, wire mesh portion 110 is run on the exterior of the lateral leg (only partially visible in FIG. 2). The lateral leg may also be referred to as a leg of a junction. The lateral leg extends into the lateral wellbore. The wire mesh portion 110 may descend from uphole and in some examples may connect to the surface. In some embodiments, an energy transfer mechanism similar to 120 electrically connects the wire mesh portion 110 with a wire mesh portion attached to a lateral wellbore completion string which may be similar (or different) than sting 140, sensors 145, build show 150 et. Energy transfer mechanism 135 electrically connects wire mesh portion 125 to wire mesh portion 140. Energy transfer mechanism 135 may be the same or a different type of energy transfer mechanism as energy transfer mechanism 120. Wire mesh portion 140 runs along an exterior portion of the completion deflector 100 and connects to wellbore devices 145, such as valves and/or sensors disposed on the guide shoe 150, as well as areas wherein gas, oil, and water may be produced, controlled, and/or regulated. In some embodiments then the lateral wellbore devices (similar to 145) are now electrically connected to the lateral leg via wire mesh portions which may be similar to 110, 125, and 140 and an electrical signal may be transmitted to the lateral wellbore devices (similar to 145) from a location uphole of the lateral leg and lateral completion string. The series of wire mesh portions 110, 125, and 140 may be used to actuate the lateral wellbore devices similarly to 145, provide instructions to the wellbore devices similar to 145, and/or to convey information to/from the lateral wellbore devices similar to 145. In some examples, some or all of the lateral wellbore devices and/or main wellbore devices may be used to provide instructions to convey information to and/or from the wellbore devices as well as to actuate them.

The ability to use a wire mesh to enable the transfer of signals and energy in small, constrained areas under harsh conditions (e.g., dirty environments or contaminated fluids), extreme pressures (e.g., >20,000-psi differential), extreme temperatures (e.g., <−20° F. or >300° F.), makes this disclosure suitable for use in other harsh environments such as outer space (e.g., satellites, spacecrafts, etc.), aeronautics (aircrafts), on-ground (swamps, marshes, etc.), below ground (mines, caves, etc.), ocean (on surface and subsea), subterranean (mineral extraction, storage wells (carbon sequestration, carbon capture and storage (CCS), etc.), and other energy recovery activities (geothermal, steam, etc.).

Figure 3:
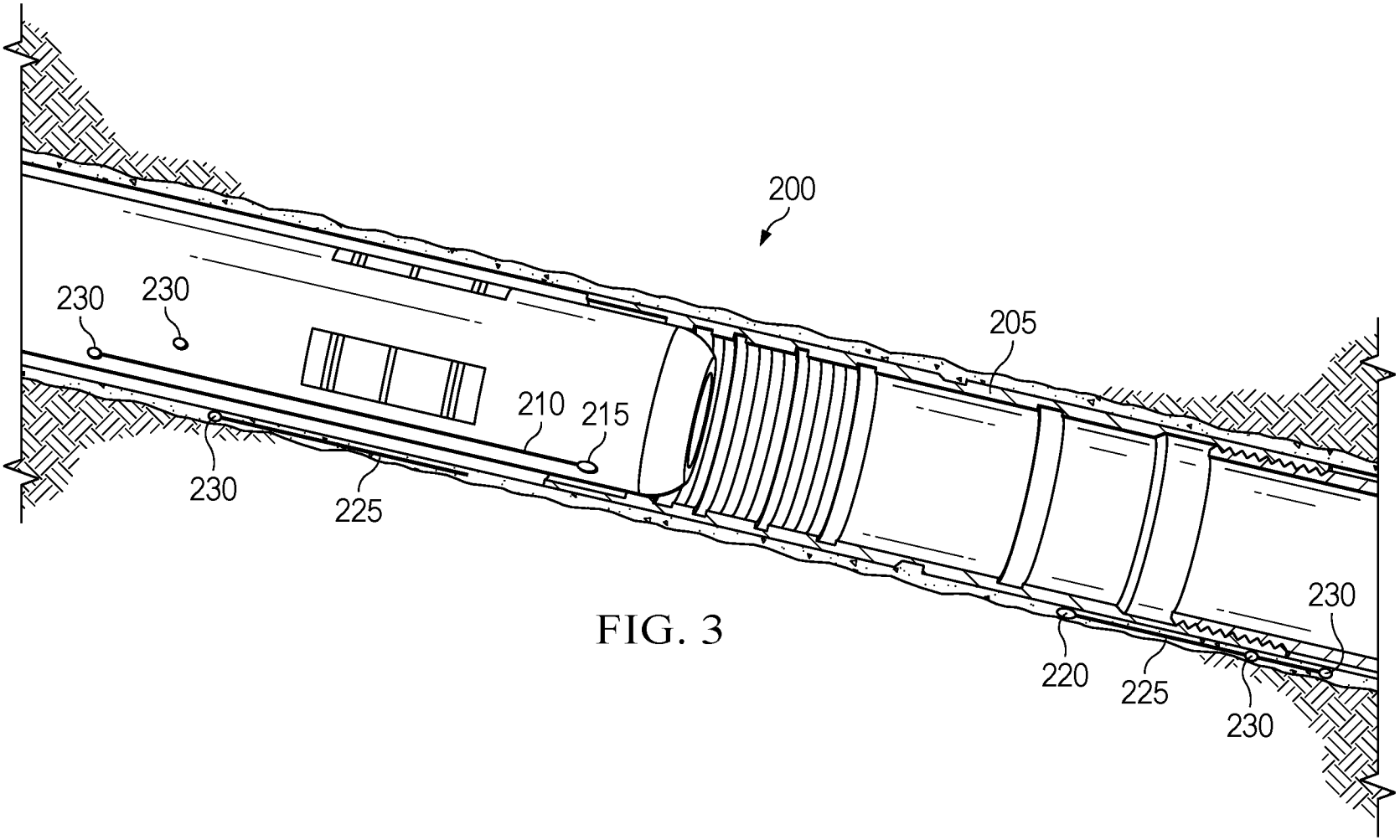
FIG. 3 is a perspective drawing illustrating an example latch assembly before connection with a latch coupling in accordance with one or more examples described herein.

FIG. 3 is a perspective drawing illustrating an example completion tool, a latch assembly 200, before connection with a latch coupling 205. In some examples, the latch assembly 200 may be a subassembly of a variety of completion tools such as completion deflectors, milling machines, whipstocks, packers, etc. A wire mesh 210 is run on the exterior of the latch assembly 200. The wire mesh 210 descends from uphole and in some examples may connect to the surface. The latch assembly 200 comprises an energy transfer mechanism 215 which is electrically coupled to the wire mesh 210. When the latch assembly 200 engages with the latch coupling 205, the energy transfer mechanism 215 will engage with a paired energy transfer mechanism 220 disposed on the interior of the latch coupling 205. Energy transfer mechanisms 215 and 220 may be wet connects, inductive couplings, dry-mate connectors (e.g., dual-seal dry-mate connectors), or any other such energy transfer mechanisms sufficient for electrically coupling wire mesh 210 with wire mesh 225. Wire mesh 225 extends along the interior of the latch coupling 205 and is electrically connected to wellbore devices 230. Wellbore devices 230 may be any type of wellbore devices. Examples of wellbore devices 230 include, but are not limited to, sensors batteries, computers, logic devices, flow controllers, pressure controllers, temperature controllers, cameras, actuation devices, or any combination of wellbore devices.

Figure 4:
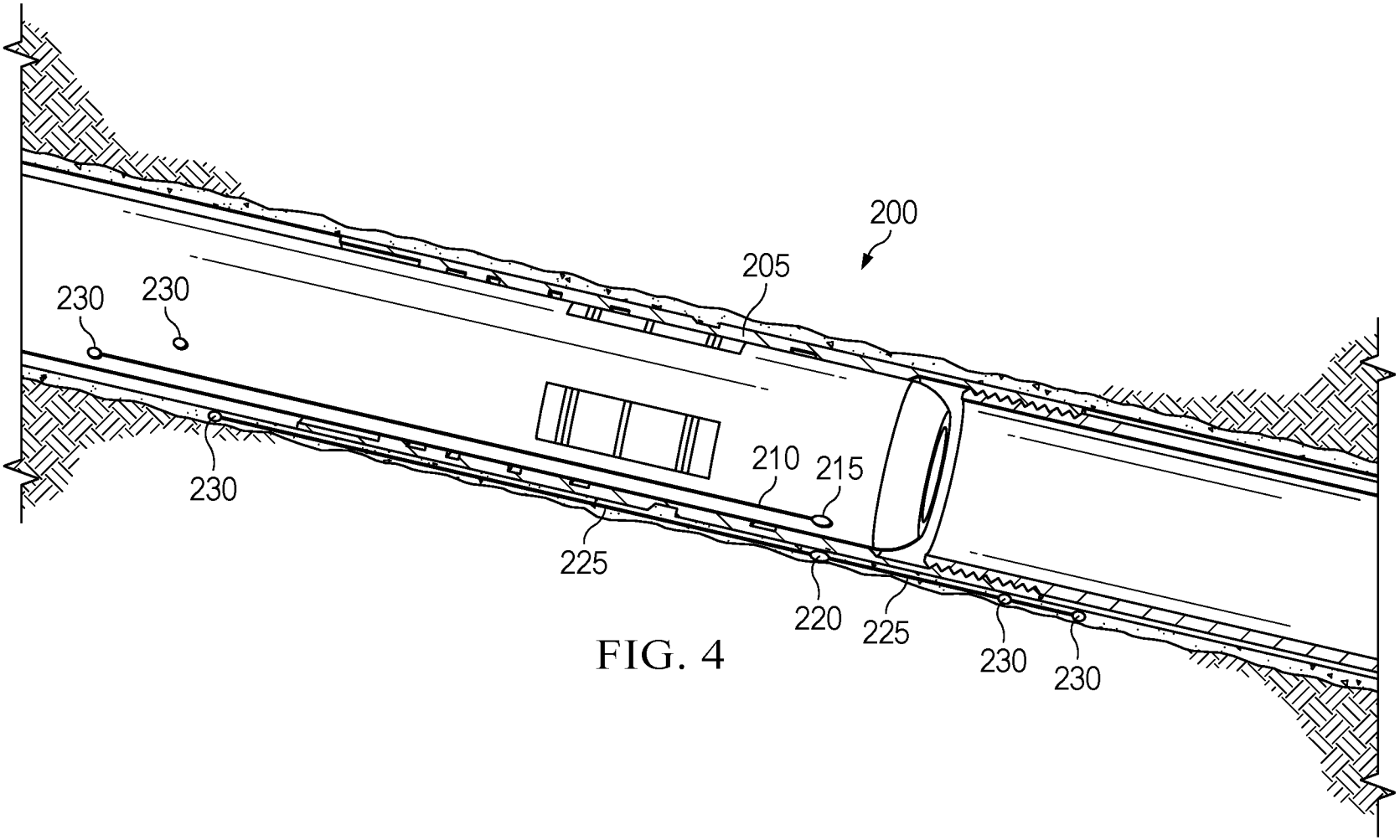
FIG. 4 is a perspective drawing illustrating the example latch assembly of FIG. 3 after connection with a latch coupling in accordance with one or more examples described herein.

FIG. 4 is a perspective drawing illustrating the latch assembly 200 and latch coupling 205 of FIG. 3 after the latch assembly 200 has moved into a position to couple to the latch coupling 205. When the latch assembly 200 engages with the latch coupling 205, the energy transfer mechanism 215 will engage with its paired energy transfer mechanism 220 which is disposed on the interior of the latch coupling 205. The wire mesh 225 that extends along the interior of the latch coupling 205 is electrically connected to wellbore devices 230 which may now be actuated and/or may now receive or transmit electrical signals via wire mesh 210 and 225. Wellbore devices 230 may be any type of wellbore devices. Examples of wellbore devices 230 include, but are not limited to, sensors batteries, computers, logic devices, flow controllers, pressure controllers, temperature controllers, cameras, actuation devices, or any combination of wellbore devices.

In some examples, the energy transfer mechanism 215 and its paired energy transfer mechanism 220 may not be required or utilized. For example, wire mesh 225 may be attached to wellbore devices like 230 including, but are not limited to, sensors, batteries, computers, logic devices, flow controllers, pressure controllers, temperature controllers, cameras, actuation devices, or any combination of wellbore devices 230. The purpose of wire mesh 225 and wellbore devices 230 (e.g., sensors) may be to confirm the latch-in of latch assembly 200 into latch coupling 205. Likewise, wire mesh 225 may monitor, transfer data, or provide power to one or more wellbore devices 230 mounted along the completion tool and string which may be connected partially or fully back to the surface.

In some examples, the wire mesh 225 shown in FIG. 4 may be connected to one or more energy transfer mechanisms similar to 120 and/or 135 shown in FIG. 2 and/or energy transfer mechanism 215 shown FIG. 4. This example may provide power and monitor data from other wellbore devices 230 further downhole. As a further example, an energy transfer mechanism (e.g., energy transfer mechanism 215 or 220) could transfer power and data to a different string (e.g., the string containing wire mesh 140 as illustrated by FIG. 2) as well as the sensors, actuators, and/or other wellbore devices 230 on that different string.

Figure 5:
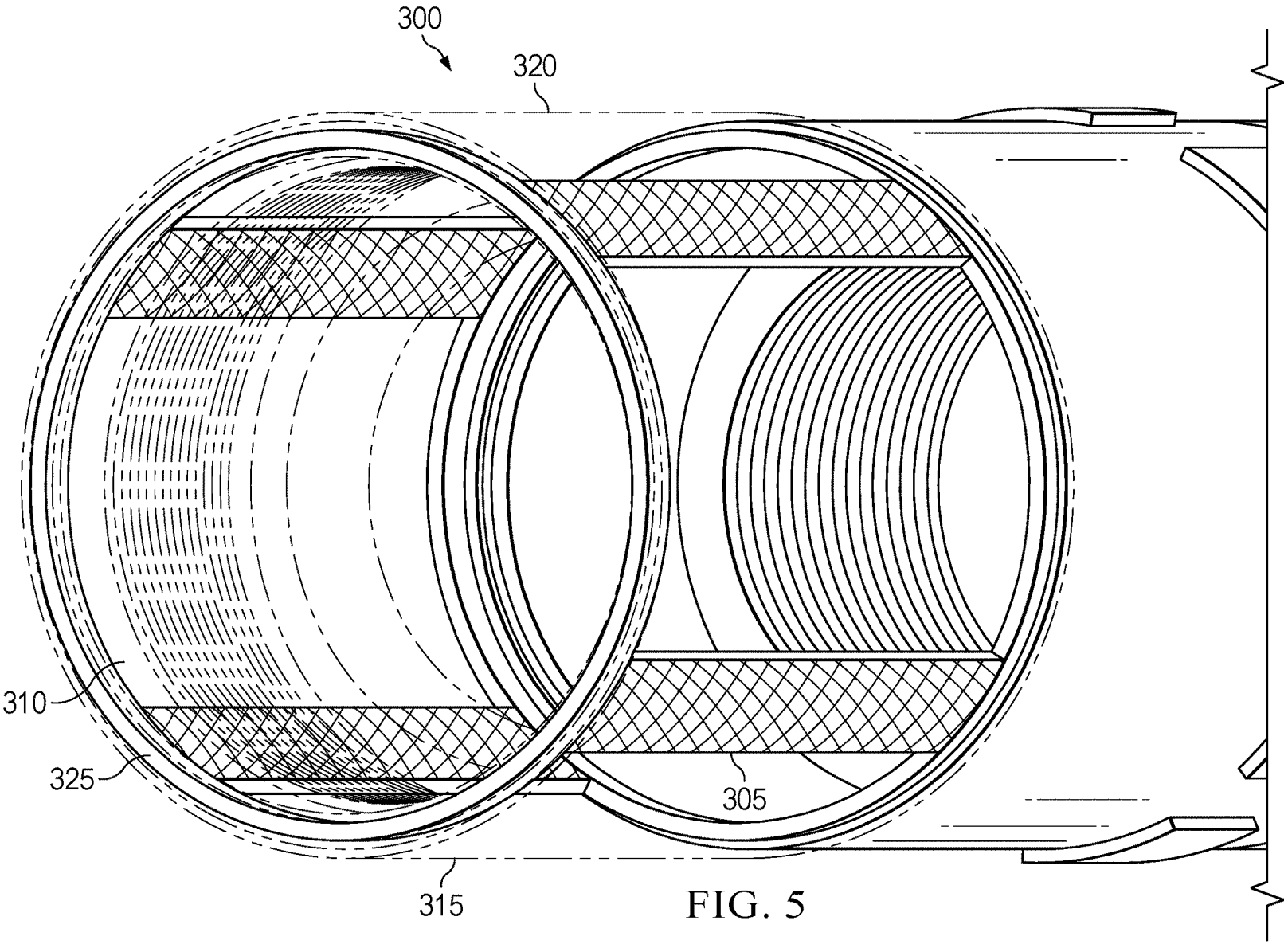
FIG. 5 is a perspective drawing illustrating a top subassembly having a wire mesh disposed within an inner wall and outer wall of a housing in accordance with one or more examples described herein.

FIG. 5 is a perspective drawing illustrating a top subassembly 300 having a wire mesh 305 disposed within an inner wall 310 and outer wall 315 of a housing 320. Electrical conductor ring 325 is also embedded within the inner wall 310 and outer wall 315 of the housing 320. This specific example of the wire mesh 305 is illustrated as four mesh forms (e.g., bars, strands, elements, etc.) extending axially from the uphole end of the subassembly 300 to the downhole end. These four mesh forms may be disposed within a single void within and around the circumference of the housing 320, or they may be installed in multiple voids (e.g., 2, 3, or 4 voids) spaced around the circumference of the housing 230 and running in the axial direction along the length of the subassembly 300 or wellbore tool. The electrical conductor ring 325 may be mechanically attached to the four mesh forms to convey electrical signals to the wire mesh 305 from uphole. The electrical conductor ring 325 may be crushable, spring-loaded, or otherwise urged to stay mechanically coupled with another mating electrical conductor from another wellbore tool that may be connected to item the electrically conductor ring 325 and/or any part of the housing 320. The electrical conductor ring 325 and/or the inner wall 310 and/or the outer wall 315 of the housing 320 may further comprise seals, barriers, and/or one or more fluids to insulate, isolate, and prevent debris from interfering with the deployment of the electrical conductor ring 325 into the well and also when connecting the electrical conductor ring 325 to its mating counterpart. The housing 320 may comprise a full-circle sleeve that the wire mesh 305 is disposed within. In some optional examples, the wire mesh 305 may comprise its own insulation to protect it from being electrical-conductive with the inner portion and/or outer portion of the subassembly 300. In some examples, the housing 320 may comprise electrical insulation to protect the four mesh forms of the wire mesh 305. In some examples, the housing 320 may comprise electrical insulation and/or other devices (e.g., insulated wiper rings) to protect the electrical conductor ring 325. In some examples, the housing may also comprise moisture-resistance, wear-resistance, electromagnetic-shielding, and/or fluid-tight characteristics or elements.

Figure 6:
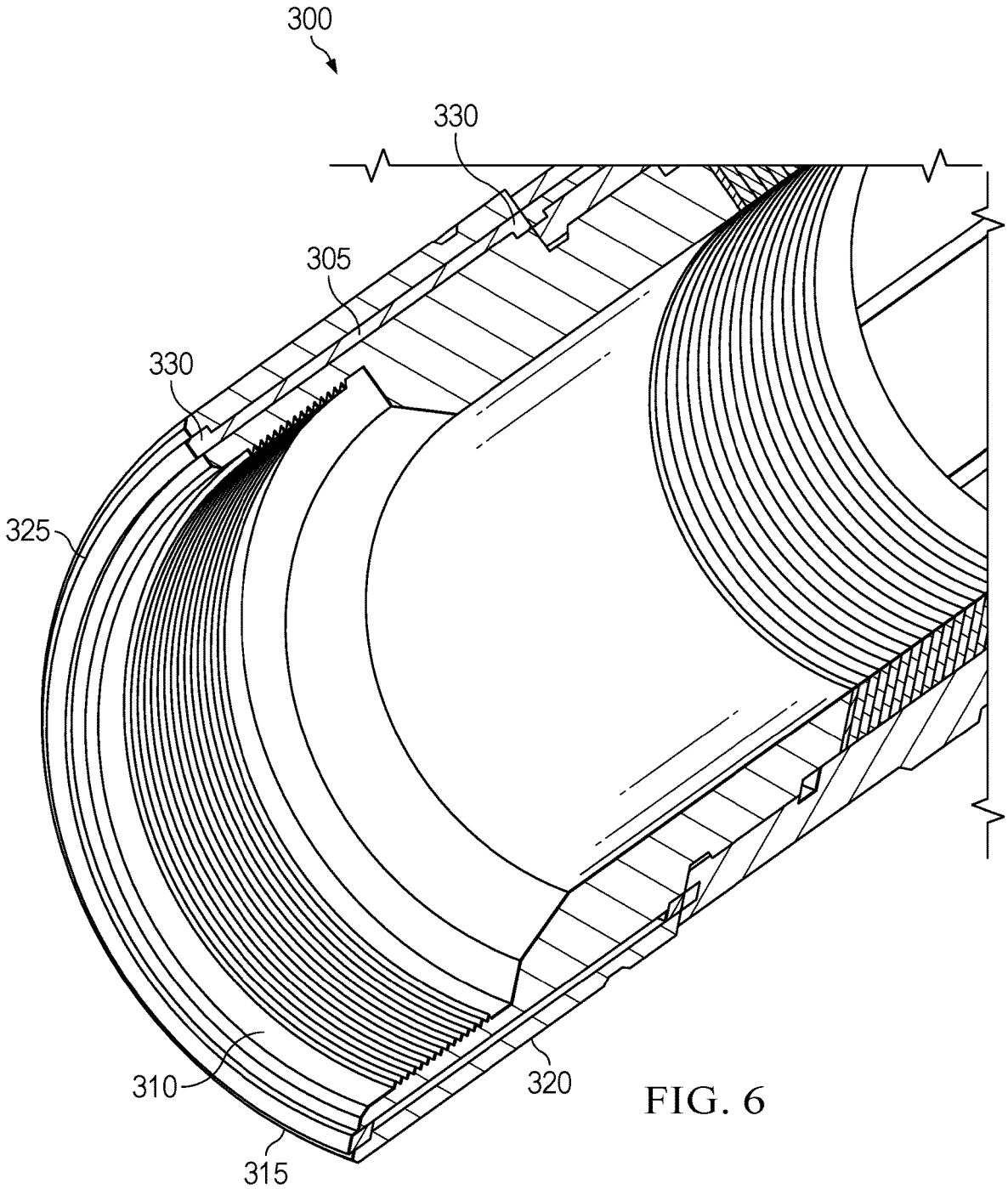
FIG. 6 is a cross-section drawing illustrating the top subassembly of FIG. 5 in accordance with one or more examples described herein.

FIG. 6 is a cross-section drawing illustrating the top subassembly 300 of FIG. 5. The electrical conductor ring 325 is mechanically attached to the wire mesh 305 to convey electrical signals to the wire mesh 305 from uphole. The housing 320 may be affixed to the wire mesh 305 and the electrical conductor ring 325 with threads, pins, rods, dowels, stiffeners, spacers, inserts, chemicals, composites, and/or any sufficient mechanism for coupling the wire mesh 305 to the housing 320 and the electrical conductor ring 325. To ensure the wire mesh 305 does not move or twist, composite spacers may be placed between each of the four mesh bars forms. The composites may resist corrosion and bond to one or more components (i.e. mesh forms, inner wall, outer wall, etc.) for structural integrity. The composites may provide support for the wire-mesh upper compression contact and/or the lower electrical connector. A chemical may be used to water-proof the downhole connector 330 and to prevent entry of fluids from either end of the top subassembly 300. In some examples, the wire mesh 305 may be mounted in one or more solitary voids without spacers. In this specific example, additional material (e.g., steel) may be placed between the inner and outer diameter of top subassembly 300 to increase its strength.

Figure 7:
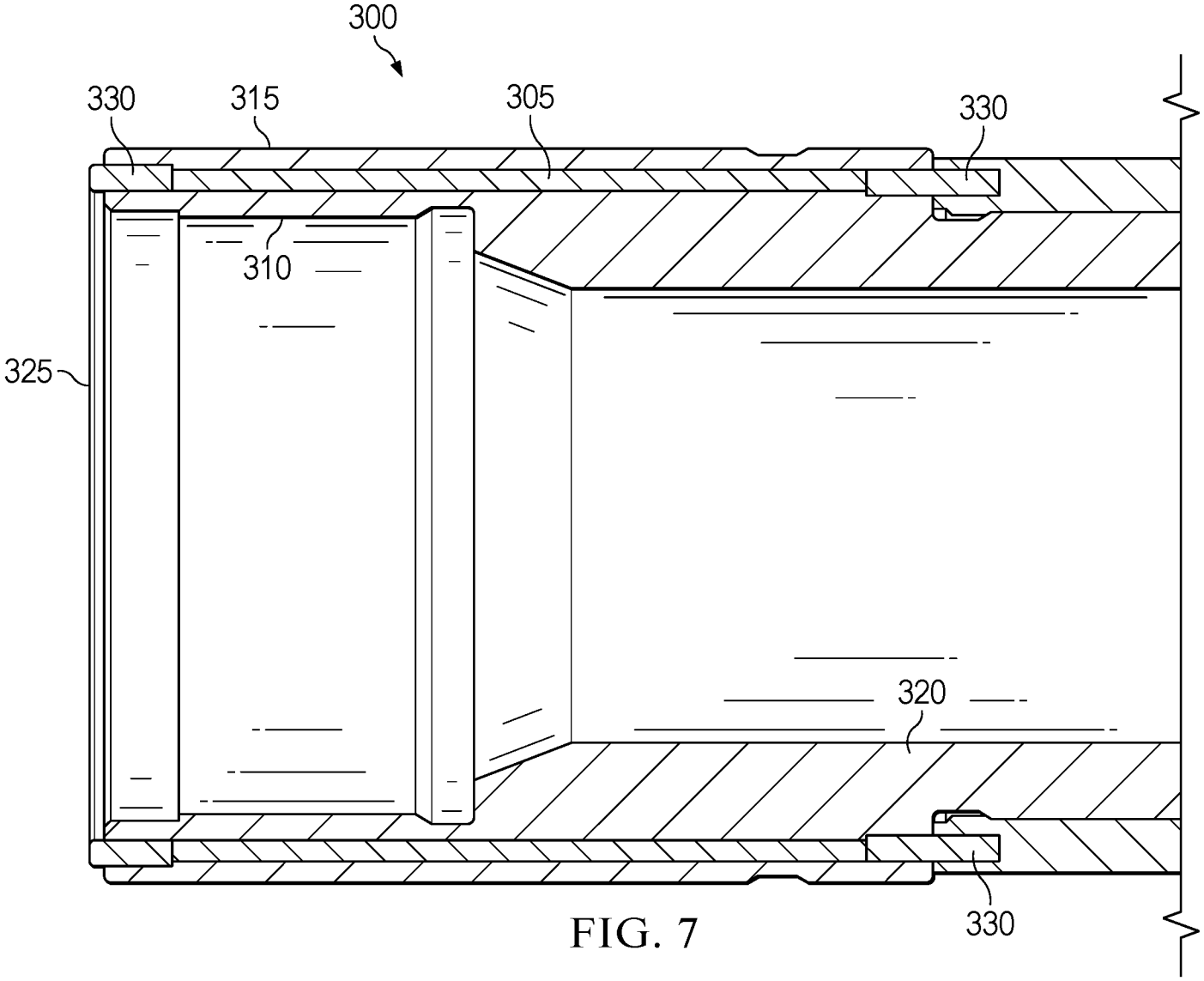
FIG. 7 is a cross-section of the top subassembly of FIGS. 5 and 6 and illustrating a rigid electrical connector in accordance with one or more examples described herein.

FIG. 7 is another cross-section of the top subassembly of FIGS. 5 and 6. The electrical connector 330 of FIG. 7 is a rigid electrical connector. Each end of the top subassembly 300 comprises these species of electrical connectors 330. In some examples, the rigid electrical connectors comprise mating compliant connectors that possess compliancy to keep the electrical connectors 330 in constant contact in order to ensure a positive electrical connection can be maintained during vibration, rotation, pressure-surges, and the like.

Figure 8:
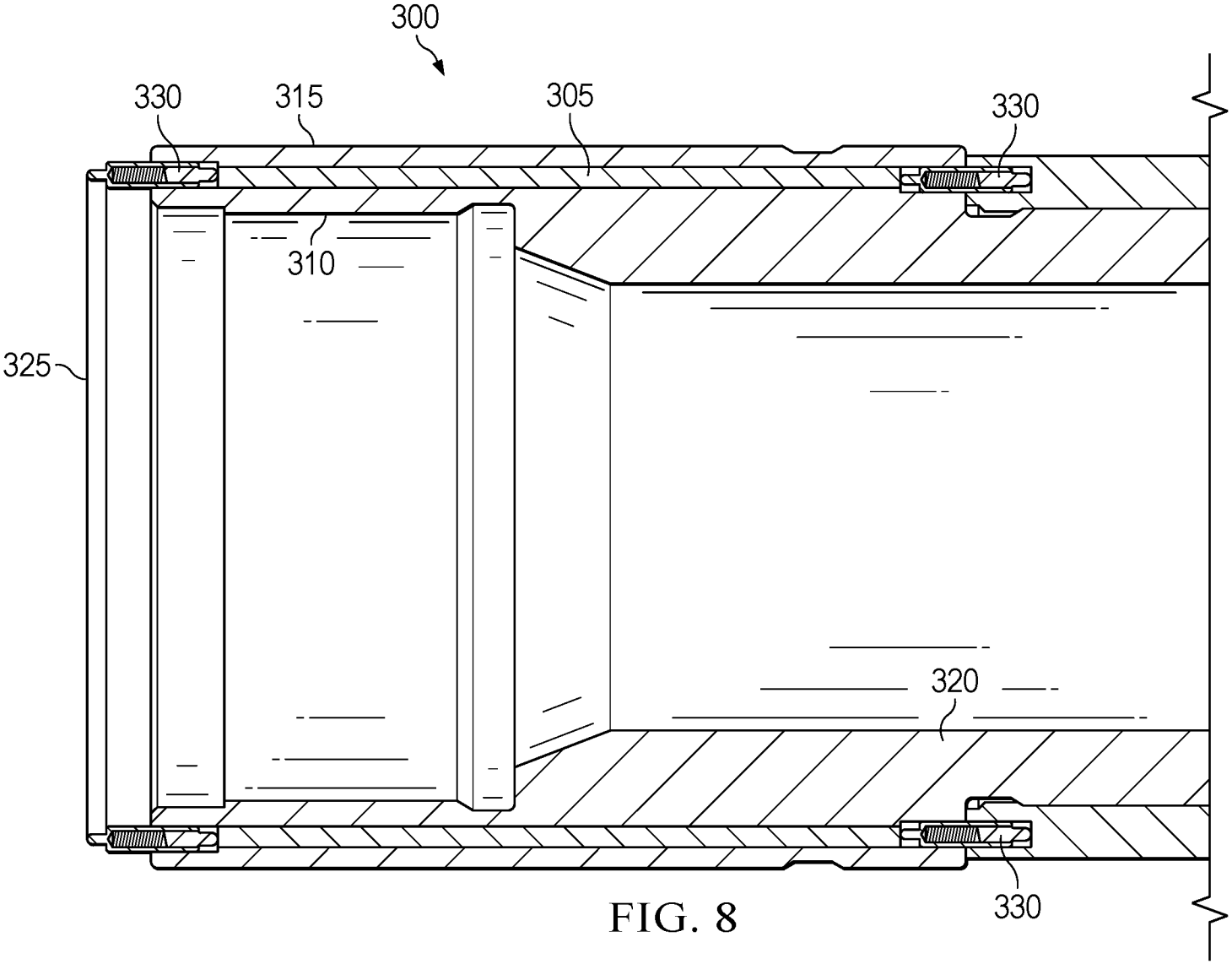
FIG. 8 is a cross-section of the top subassembly of FIGS. 5 and 6 and illustrating a spring electrical connector in accordance with one or more examples described herein.

FIG. 8 is another cross-section of the top subassembly of FIGS. 5 and 6. The electrical connector 330 of FIG. 8 is a spring-loaded electrical connector (e.g., a coiled spring, leaf spring, etc.). Each end of the top subassembly 300 comprises these species of electrical connectors 330. In some specific examples, the spring electrical connector is a snap-lock, trigger-release electrical connector having a spring-loaded contact system. The biased plunger of the spring-loaded contact system may be machined from a copper alloy or sheet metal.

Figure 9:
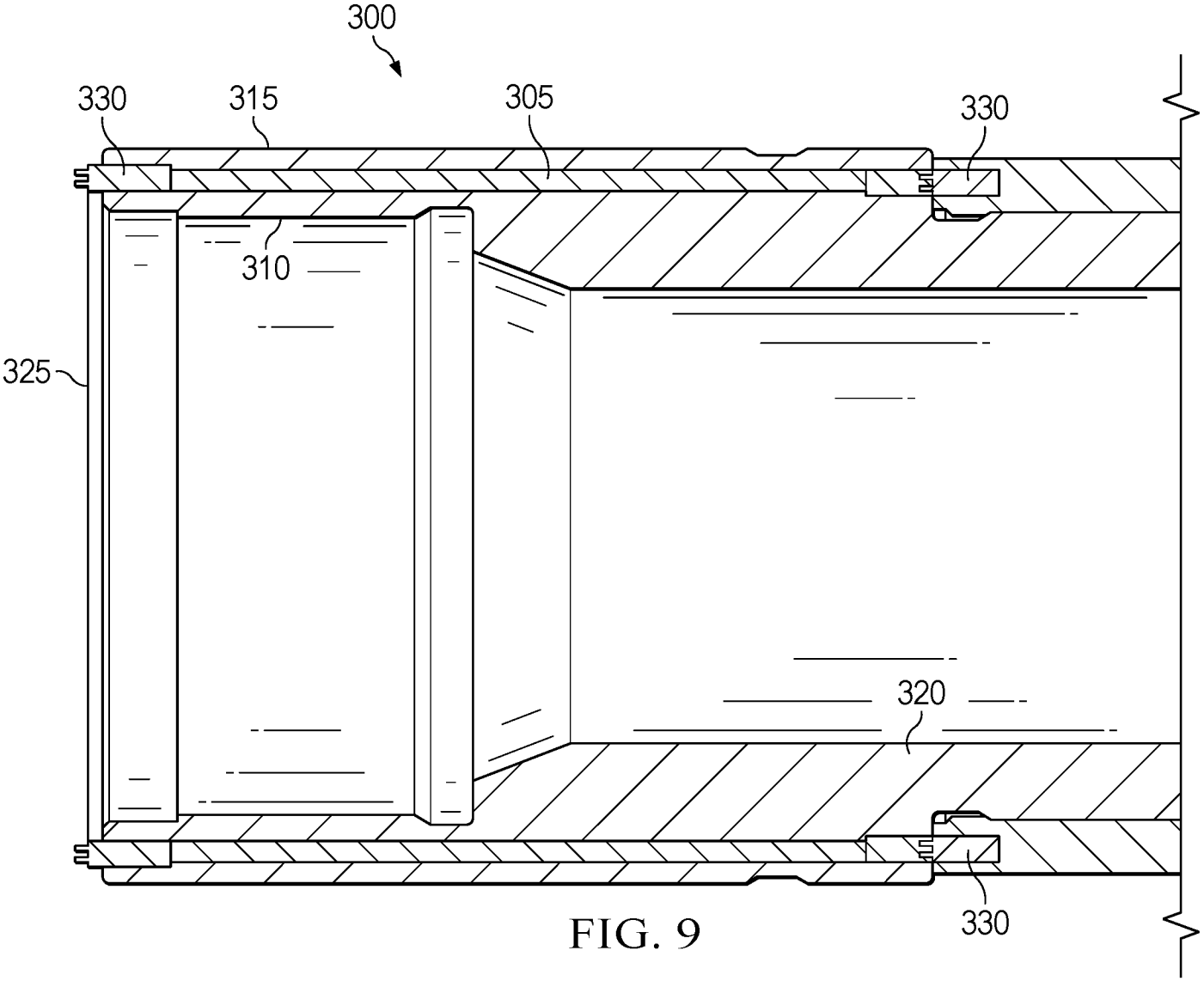
FIG. 9 is a cross-section of the top subassembly of FIGS. 5 and 6 and illustrating an over-molded electrical connector in accordance with one or more examples described herein.

FIG. 9 is another cross-section of the top subassembly of FIGS. 5 and 6. The electrical connector 330 of FIG. 9 is an over-molded connector. Each end of the top subassembly 300 comprises these species of electrical connectors 330. Over-molded connectors may allow the electrical connectors 330 to be mated even when the faces are wet or otherwise contaminated. This capability is generally achieved by over-molding an elastomeric layer on the face of the electrical connector 330. This over-mold may include structures that wipe the connector interfaces as the pairs of the electrical connectors 330 are mated.

In some alternative examples, a wet-mate electrical connector may be used. Wet-mate connectors are capable of being connected and disconnected while submerged. Examples of wet-mate connectors include, but are not limited to, dielectric grease connectors, oil-filled pressure-balanced connectors, vented pin and socket connectors, fiber optic connectors, niobium wet-mate connectors, and the like.

Figure 10:
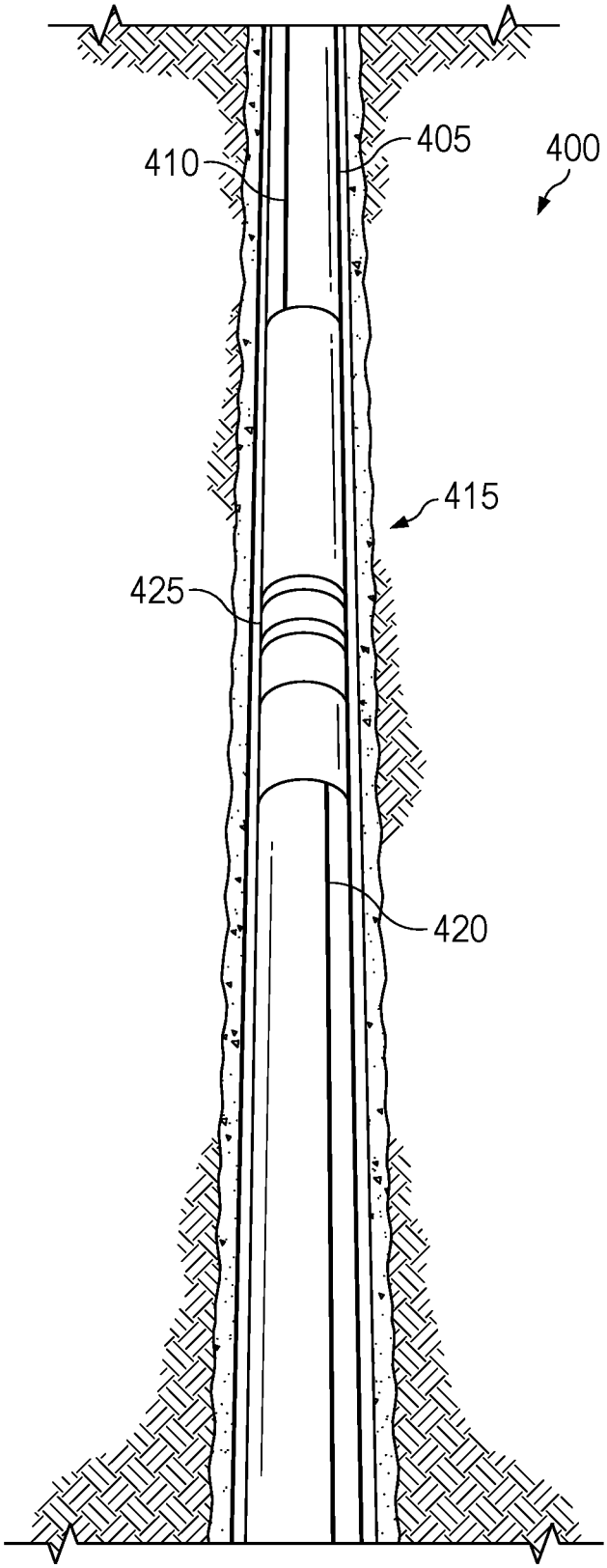
FIG. 10 is a perspective drawing illustrating a system utilizing a wire mesh to actuate a packer in accordance with one or more examples described herein.

FIG. 10 is a perspective drawing illustrating a system, generally 400, utilizing a wire mesh 410 for signal transference. A completion tool 405 (e.g., a running tool) comprises a wire mesh 410 mounted on its exterior. Although the wire mesh 410 is mounted to the exterior, it is to be understood that in other examples it could reside in a void between an inner and outer wall of the completion tool 405 or within the interior of the completion tool 405. A packer 415 (i.e., a wellbore device) is disposed on the completion tool 405. The wire mesh 410 transitions to the interior of the packer 415 from the exterior of the packer 415 due to the intended expansion of the sealing element 425 of the packer 415 when actuated at depth. A pressure and/or fluid barrier may be placed at the location of the transition to prevent leakage. The wire mesh 410 transitions once again to the exterior of the completion tool 405 when downhole of the packer 415. The wire mesh 410 may be used to initiate actuation of the packer 415 and/or to confirm orientation and proper setting of the packer 415. The wire mesh 410 may also be coupled to other downhole tools such as sensors for tension, compression, torque, pressure, temperature, acoustics, etc. In some examples, the wire mesh 410 provides two-way communication and may transmit electrical signals uphole as well as downhole.

In some examples, the completion tool 405 (e.g., a running tool) may be connected to the surface using a tubular string such as drill pipe, a work string (drill pipe and/or tubing), or other type of conduit. The wire mesh 410 may be connected to an electrical wire that is ran with the drill pipe, work string, etc. In some examples, the pipe may be a wired drill pipe. In other examples, acoustical or other energy forms may be used to transmit signals from the wire mesh to the surface (or from the surface to one or more wire meshes). As discussed above, completions, and in particular, workover operations, may utilize one or more of the following: workover rigs, drilling rigs, wireline units, electrical wireline units, coiled tubing units, and snubbing units to complete a wellbore operation.

Figure 11:
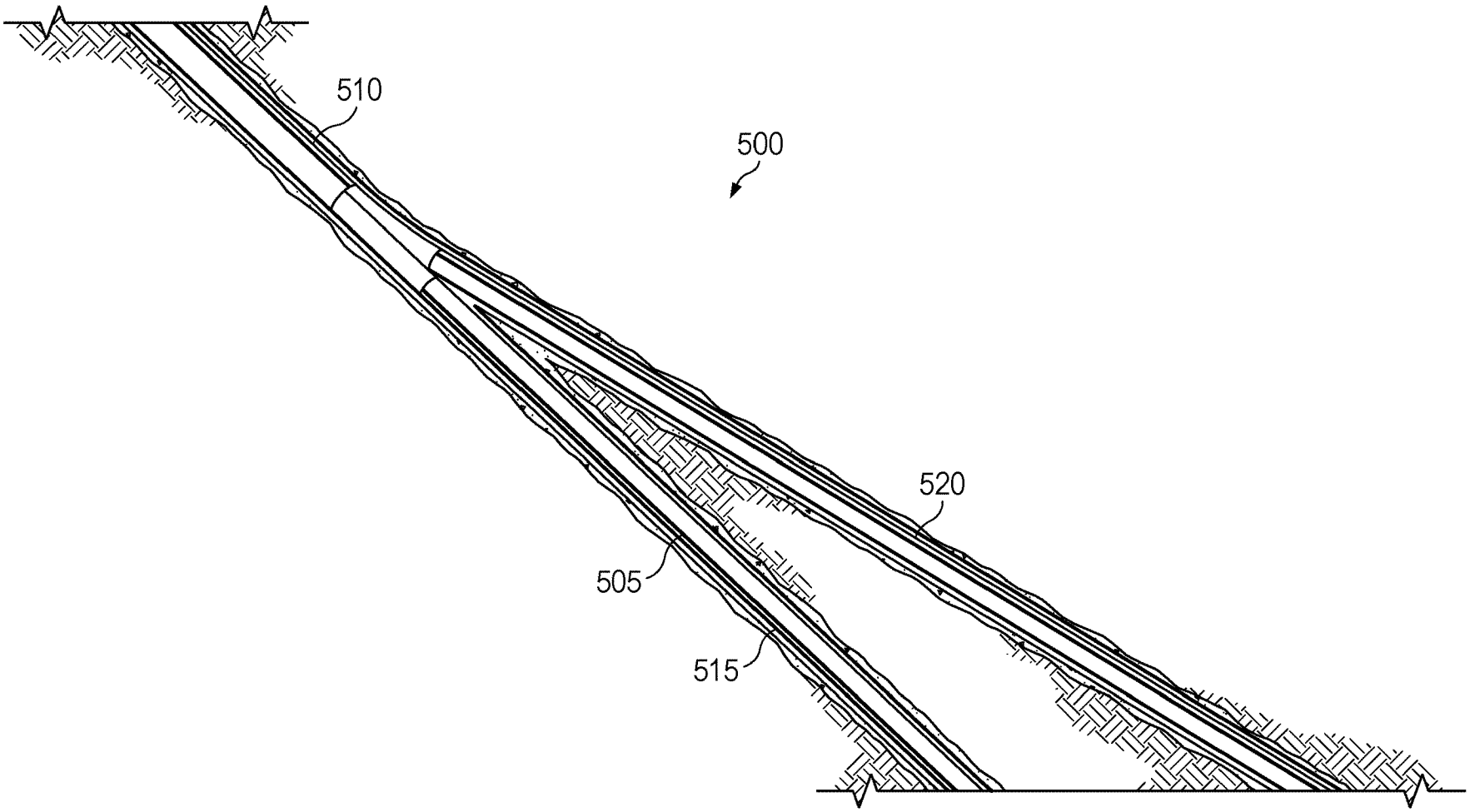
FIG. 11 a perspective drawing illustrating a multi-lateral junction comprising a wire mesh in accordance with one or more examples described herein.

FIG. 11 is a perspective drawing illustrating a multilateral junction, generally 500, comprising a wire mesh 505. In the illustrated example, the wire mesh descends from the completion tool 510 (e.g., a running tool, packer, etc.) uphole of the junction point to both the mainbore leg 515 and the lateral leg 520 of the multi-lateral junction 500. The wire mesh 505 may be disposed on the exterior, within a void space or shapes between an inner and outer wall, or located in the interior of any of the tools at any point of the multi-lateral junction 500 and may transition from one orientation to another at any point of the multi-lateral junction 500. A dotted line is used to show the general path of the wire mesh 505 and does not indicate whether the wire mesh 505 is disposed on the exterior, within a void space between an inner and outer wall, or located in the interior of any of the tools and it is to be understood that the location of the wire mesh 505 on the tool will be chosen to fit the desired application. Energy transfer mechanisms, as discussed above, may be used to continue transference of electrical signals at transition points of the wire mesh 505 as it proceeds along the multi-lateral junction 500.

Figure 12:
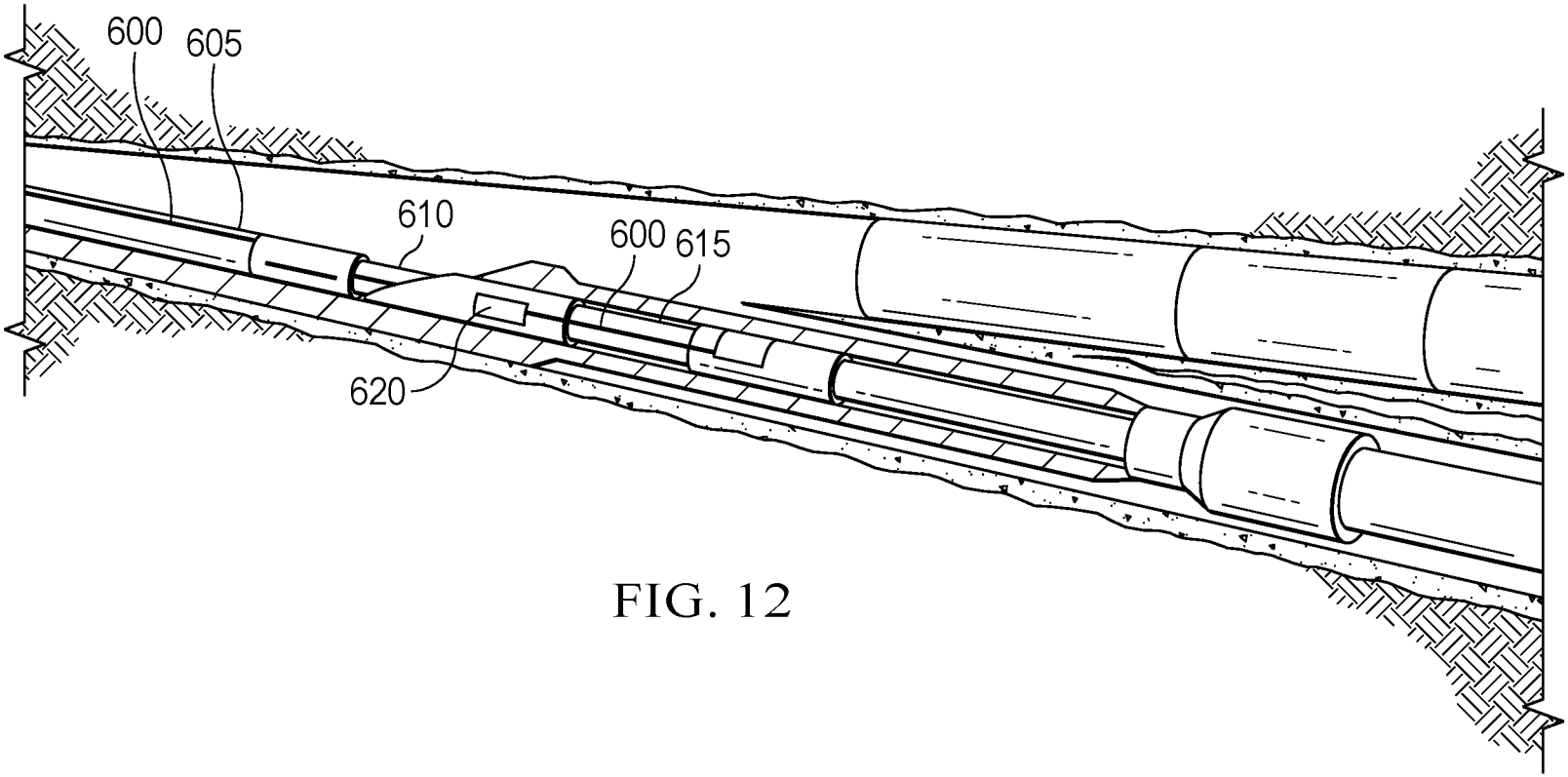
FIG. 12 is a perspective drawing illustrating a wire mesh located on the wireline, slickline, or coiled tubing used to run the completion tool in the wellbore in accordance with one or more examples described herein.

FIG. 12 is a perspective drawing illustrating a wire mesh 600 located on the wireline, slickline, or coiled tubing used to run the completion tool (e.g., a running tool) in the wellbore. In this illustrated example, wire mesh 600 extends along the coiled tubing 605 descending from the surface. The wire mesh 600 transitions from the coiled tubing 605 to the tubing exit whipstock running tool 610 and then to the tubing exit whipstock 615. An energy transfer mechanism 620, as discussed above, is used to continue electrical transference between the tubing exit whipstock running tool 610 and the tubing exit whipstock 615. The wire mesh 600 may then continue downhole to electrically couple to a wellbore device such as a valve, sensor, load cell, etc. The wire mesh 600 may be disposed on the exterior, within a void space between an inner and outer wall, or located in the interior of any of the tools including the coiled tubing 605 and may transition from one orientation to another at any point. A dotted line is used to show the general path of the wire mesh 600, and does not indicate whether the wire mesh 600 is disposed on the exterior, within a void space between an inner and outer wall, or located in the interior of any of the tools and it is to be understood that the location of wire mesh 600 on the tool will be chosen to fit the desired application. In some examples, the wire mesh 600 may be located on a wireline, slickline, electric line, jointed pipe, or coiled tubing. The wire mesh 600 may be attached to wellbore devices such as a valve, sensor, load cell, etc. associated with the wireline, slickline, electric line, jointed pipe, or coiled tubing. The wire mesh 600 may also be attached to a running or retrieving tool such as the tubing exit whipstock running tool 610. In other examples, the wire mesh 600 may be electrically connected to a running tool (or a retrieving tool) such as tubing exit whipstock running tool 610 while also electrically connected to a tool such as the tubing exit whipstock 615.

Figure 13:
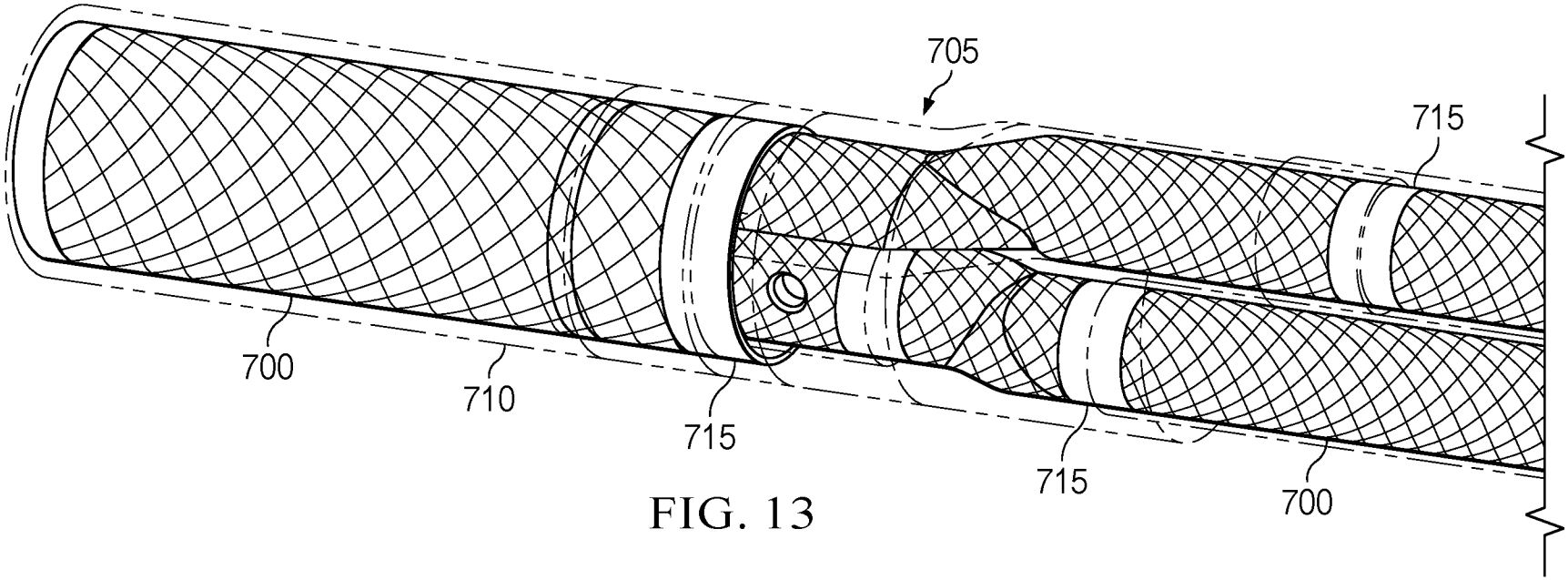
FIG. 13 is a perspective drawing illustrating a wire mesh incorporated into a multilateral junction in accordance with one or more examples described herein.

FIG. 13 is a perspective drawing illustrating the wire mesh 700 running either internally or within a void space (or spaces) between an inner and outer wall of a multilateral junction 705. The wire mesh 700 may be formed into a desired shape outside of the multilateral junction 705 and then fitted to the contours of the inside of the multilateral junction 705. The wire mesh 700 is flexible and may be inserted into the inside of the multilateral junction 705 or over the inner wall of the multilateral junction 705. The exterior portion 710 (drawn as translucent for clarity of illustration) of the multilateral junction 705 provides structural support to the wire mesh 700. Even though FIG. 13 shows the multilateral junction 705 mounted over the wire mesh it is to be understood that the wire mesh 710 may be disposed on the exterior, interior, or between walls of the housing of the multilateral junction 705. To aid with assembly of the wire mesh 700 in the multilateral junction 705. The wire mesh 700 may be made into smaller sections of a specific shape and fit that corresponds to each of the multilateral junction 705 parts. The wire mesh 700 may then be connected to the connectors 715 to maintain continuous signal transference along the multilateral junction 705. In some optional examples, the wire mesh 700 may be coated or covered with a sheath or other such coating (e.g., an epoxy) to isolate the wire mesh 700 from abrasion or flow within the multilateral junction 705.

It should be clearly understood that the example systems illustrated by FIGS. 1-13 are merely general applications of the principles of this disclosure in practice, and a wide variety of other examples are possible. Therefore, the scope of this disclosure is not limited in any manner to the details of FIGS. 1-13 as described herein.

The wire mesh may be used with completion tools in the wellbore. When in the wellbore, the wire mesh may transmit an electrical signal to or from a wellbore device. Examples of completion tools may include, but are not limited to, running tools, packers, latches, latch cleaning assemblies, multilateral junctions, completion deflectors, whipstocks, dual bore deflectors, or any other such tools used during the completion phase of the well development. In some examples, the wire mesh may also be used on casing related tools used during the completion phase including, but not limited to, casing joints, tubing joints, window joints (e.g., pre-cut, aluminum, etc.), latch couplings (e.g., orientation, depth, etc.), alignment subassemblies, bushings, casing orientation tools, cement-related equipment (e.g., float shoes, float collars, etc.) liner hangers, external packers, open hole anchors, and the like.

The wire mesh may be used to transmit an electrical signal to and, in some examples, from a wellbore device. Examples of wellbore devices may include, but are not limited to, valves, sensors, packers, computers, batteries, controllers, logic devices, smart sensors, edge computers, edge sensors, machine-learning sensors, machine-learning devices, neural network devices, artificial intelligence devices, and the like. The wire mesh may initiate activation of the wellbore devices, may provide power to the wellbore devices, may receive feedback from the wellbore devices, may confirm orientation or the setting of wellbore devices, may act as a battery of a wellbore device, may provide real time data monitoring of wellbore devices, or any other such functions which may be performed via electrical transference along the wire mesh. The wire mesh possesses a smaller cross-section than a control line and may serve as a replacement for a control line for some applications. Additionally, the smaller cross-section of the wire mesh may allow for the wire mesh to be used in applications in which it was impossible to run a control line due to limited annular space.

The wire mesh may be coupled to energy transfer mechanisms to transition the energy/signal of the wire mesh's to another wire mesh or a downhole device. This transition may occur from one location of the completion tool to another location of the completion tool. The energy transfer mechanism may also transition the wire mesh to another completion tool or a wellbore device. Energy transfer mechanisms may allow the wire mesh to maintain signal transference across transition points or other changes in profiles and/or the type of tools or equipment. Examples of energy transfer mechanisms include, but not limited to, wet connects, inductive couplings, dry-mate connectors (e.g., dual-seal dry-mate connectors), or any other such energy transfer mechanisms sufficient for electrically coupling the wire mesh to a completion tool, wellbore device, or another section of wire mesh.

The wire mesh and associated system components disclosed herein may directly or indirectly affect one or more components or pieces of equipment associated with or which may come into contact with the wire mesh and associated system components such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are apparatus for transmitting an electrical signal in a wellbore in accordance with the disclosure and the illustrated FIGS. An example apparatus comprises a tool comprising a wire mesh. The wire mesh is disposed along at least a portion of an axial length of the tool. The wire mesh comprises a conductor configured to transmit an electrical signal along the portion of the length of the tool. The wire mesh is configured to transmit the electrical signal to a wellbore device disposed in the wellbore.

Additionally or alternatively, the apparatus may include one or more of the following features individually or in combination. The wire mesh may be disposed in at least one interior void of the tool, between an inner and outer wall of the tool, or along an exterior of the tool. The wire mesh may be configured to receive an electrical signal from an electrical wire descending from a surface penetrated by the wellbore. The wire mesh may comprise a weave having conductive and nonconductive wire; wherein the nonconductive wires have larger diameters than the conductive portion of the conductive wires. The tool may be a running tool, a packer, a latch assembly, a cleaning assembly, a multilateral junction, a deflector, a whipstock, a dual bore deflector, a casing joint, a tubing joint, a window joint, a latch coupling, an alignment subassembly, a bushing, a casing orientation tool, a float shoe, a float collar, a liner hanger, a workover tool, a downhole tool, a tool comprising an electrical device, or an open hole anchor. The wellbore device may be a valve, a sensor, a packer, a computer, a battery, a controller, a device comprising an electrical component, or a logic device. The wire mesh may be about 3 nm to about 30 mm thick and the width of the wire mesh is at least about 2 times to about 2600 times as wide as the thickness of the wire mesh. The wire mesh may transition along the portion of the length of the tool from a first location consisting of an exterior of the tool, an inner and outer wall of the tool, or an interior void of the tool to a second location consisting of an exterior of the tool, between an inner and outer wall of the tool, or an interior void of another portion of the tool. An energy transfer mechanism may transition the energy from the wire mesh from the first location to the second location; wherein the energy transfer mechanism is a physical electrical coupling or a non-contact electrical coupling. The wire mesh may be electrically coupled to the wellbore device with an energy transfer mechanism. The wire mesh may extend along the portion of the length of the tool in at least two distinct and separate mesh forms.

Provided are methods for transmitting an electrical signal in a wellbore in accordance with the disclosure and the illustrated FIGS. An example method comprises introducing a tool comprising a wire mesh into a wellbore. The wire mesh is disposed along at least a portion of the axial length of the tool. The method further comprises transmitting an electrical signal along the wire mesh to or from a wellbore device disposed in the wellbore.

Additionally or alternatively, the method may include one or more of the following features individually or in combination. The transmitted electrical signal may actuate the wellbore device. The electrical signal may be a first electrical signal, and a second electrical signal may be transmitted from the wellbore device after the wellbore device receives the first electrical signal. The wire mesh may be disposed in at least one interior void of the tool, between an inner and outer wall of the tool, or along an exterior of the tool. The wire mesh may be configured to receive an electrical signal from an electrical wire descending from a surface penetrated by the wellbore. The wire mesh may comprise a weave having conductive and nonconductive wire; wherein the nonconductive wires have larger diameters than the conductive portion of the conductive wires. The tool may be a running tool, a packer, a latch assembly, a cleaning assembly, a multilateral junction, a deflector, a whipstock, a dual bore deflector, a casing joint, a tubing joint, a window joint, a latch coupling, an alignment subassembly, a bushing, a casing orientation tool, a float shoe, a float collar, a liner hanger, a workover tool, a downhole tool, a tool comprising an electrical device, or an open hole anchor. The wellbore device may be a valve, a sensor, a packer, a computer, a battery, a controller, a device comprising an electrical component, or a logic device. The wire mesh may be about 3 nm to about 30 mm thick and the width of the wire mesh is at least about 2 times to about 2600 times as wide as the thickness of the wire mesh. The wire mesh may transition along the portion of the length of the tool from a first location consisting of an exterior of the tool, an inner and outer wall of the tool, or an interior void of the tool to a second location consisting of an exterior of the tool, between an inner and outer wall of the tool, or an interior void of another portion of the tool. An energy transfer mechanism may transition the energy from the wire mesh from the first location to the second location; wherein the energy transfer mechanism is a physical electrical coupling or a non-contact electrical coupling.

The wire mesh may be electrically coupled to the wellbore device with an energy transfer mechanism. The wire mesh may extend along the portion of the length of the tool in at least two distinct and separate mesh forms.

Provided are systems for transmitting an electrical signal in a wellbore in accordance with the disclosure and the illustrated FIGS. An example system comprises a tool comprising a wire mesh. The wire mesh is disposed along at least a portion of the axial length of the tool. The wire mesh is a conductor configured to transmit an electrical signal along the portion of the length of the tool. The system further comprises a wellbore device disposed in the wellbore and configured to receive or transmit the electrical signal transmitted along the wire mesh.

Additionally or alternatively, the system may include one or more of the following features individually or in combination. The wire mesh may be disposed in at least one interior void of the tool, between an inner and outer wall of the tool, or along an exterior of the tool. The wire mesh may be configured to receive an electrical signal from an electrical wire descending from a surface penetrated by the wellbore. The wire mesh may comprise a weave having conductive and nonconductive wire; wherein the nonconductive wires have larger diameters than the conductive portion of the conductive wires. The tool may be a running tool, a packer, a latch assembly, a cleaning assembly, a multilateral junction, a deflector, a whipstock, a dual bore deflector, a casing joint, a tubing joint, a window joint, a latch coupling, an alignment subassembly, a bushing, a casing orientation tool, a float shoe, a float collar, a liner hanger, a workover tool, a downhole tool, a tool comprising an electrical device, or an open hole anchor. The wellbore device may be a valve, a sensor, a packer, a computer, a battery, a controller, a device comprising an electrical component, or a logic device. The wire mesh may be about 3 nm to about 30 mm thick and the width of the wire mesh is at least about 2 times to about 2600 times as wide as the thickness of the wire mesh. The wire mesh may transition along the portion of the length of the tool from a first location consisting of an exterior of the tool, an inner and outer wall of the tool, or an interior void of the tool to a second location consisting of an exterior of the tool, between an inner and outer wall of the tool, or an interior void of another portion of the tool. An energy transfer mechanism may transition the energy from the wire mesh from the first location to the second location; wherein the energy transfer mechanism is a physical electrical coupling or a non-contact electrical coupling. The wire mesh may be electrically coupled to the wellbore device with an energy transfer mechanism. The wire mesh may extend along the portion of the length of the tool in at least two distinct and separate mesh forms.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. An apparatus for transmitting an electrical signal in a wellbore, the apparatus comprises:

a tool comprising a wire mesh;

wherein the wire mesh is a weave comprising conductive wires;

wherein a thickness of the wire mesh is 3 nm to 30 mm thick and a width of the wire mesh is 2 times to 2600 times as wide as the thickness of the wire mesh;

wherein the wire mesh is disposed along at least a portion of an axial length of the tool;

wherein the wire mesh comprises a conductor configured to transmit the electrical signal along the at least the portion of the length of the tool;

wherein the wire mesh is configured to transmit the electrical signal to a wellbore device disposed in the wellbore.

2. The apparatus of claim 1, wherein the wire mesh is disposed in at least one interior void of the tool, between an inner and outer wall of the tool, or along an exterior of the tool.

3. The apparatus of claim 1, wherein the wire mesh is configured to receive the electrical signal from an electrical wire descending from a surface penetrated by the wellbore.

4. The apparatus of claim 1, wherein the wire mesh comprises nonconductive wires; wherein the nonconductive wires have larger diameters than a conductive portion of the conductive wires.

5. The apparatus of claim 1, wherein the tool is a running tool, a packer, a latch assembly, a cleaning assembly, a multilateral junction, a deflector, a whipstock, a dual bore deflector, a casing joint, a tubing joint, a window joint, a latch coupling, an alignment subassembly, a bushing, a casing orientation tool, a float shoe, a float collar, a liner hanger, a workover tool, a downhole tool, the tool comprising an electrical device, or an open hole anchor.

6. The apparatus of claim 1, wherein the wellbore device is a valve, a sensor, a packer, a computer, a battery, a controller, a device comprising an electrical component, or a logic device.

7. The apparatus of claim 1, wherein the wire mesh transitions along the at least the portion of the length of the tool from a first location consisting of an exterior of the tool, an inner and outer wall of the tool, or an interior void of the tool to a second location consisting of the exterior of the tool, between the inner and outer wall of the tool, or the interior void of another portion of the tool.

8. The apparatus of claim 7, wherein an energy transfer mechanism transitions energy from the wire mesh from the first location to the second location;

wherein the energy transfer mechanism is a physical electrical coupling or a non-contact electrical coupling.

9. The apparatus of claim 1, wherein the wire mesh is electrically coupled to the wellbore device with an energy transfer mechanism.

10. The apparatus of claim 1, wherein the wire mesh extends along the at least the portion of the length of the tool in at least two distinct and separate mesh forms.

11. A method for transmitting an electrical signal during a completion operation, the method comprises:

introducing a tool comprising a wire mesh into a wellbore;

wherein the wire mesh is a weave comprising conductive wires;

wherein a thickness of the wire mesh is 3 nm to 30 mm thick and a width of the wire mesh is 2 times to 2600 times as wide as the thickness of the wire mesh;

wherein the wire mesh is disposed along at least a portion of an axial length of the tool; and transmitting the electrical signal along the wire mesh to or from a wellbore device disposed in the wellbore.

12. The method of claim 11, wherein the transmitted electrical signal along the wire mesh actuates the wellbore device.

13. The method of claim 11, wherein the transmitted electrical signal along the wire mesh is a first transmitted electrical signal, and wherein a second electrical signal is transmitted from the wellbore device after the wellbore device receives the first transmitted electrical signal.

14. The method of claim 11, wherein the tool is a running tool, a packer, a latch assembly, a cleaning assembly, a multilateral junction, a deflector, a whipstock, a dual bore deflector, a casing joint, a tubing joint, a window joint, the tool comprising an electrical device, a latch coupling, an alignment subassembly, a bushing, a casing orientation tool, a float shoe, a float collar, a liner hanger, a workover tool, a downhole tool, or an open hole anchor.

15. The method of claim 11, wherein the wellbore device is a valve, a sensor, a packer, a computer, a battery, a controller, a device comprising an electrical component, or a logic device.

16. The method of claim 11, wherein the wire mesh transitions along the at least the portion of the axial length of the tool from a first location consisting of an exterior of the tool, an inner and outer wall of the tool, or an interior void of the tool to a second location consisting of the exterior of the tool, between the inner and outer wall of the tool, or the interior void of the tool.

17. A system for transmitting an electrical signal in a wellbore, the system comprises:

a tool comprising a wire mesh;

wherein the wire mesh is a weave comprising conductive wires;

wherein a thickness of the wire mesh is 3 nm to 30 mm thick and a width of the wire mesh is 2 times to 2600 times as wide as the thickness of the wire mesh;

wherein the wire mesh is disposed along at least a portion of an axial length of the tool;

wherein the wire mesh comprises a conductor configured to transmit the electrical signal along the at least the portion of the length of the tool;

a wellbore device disposed in the wellbore and configured to receive or transmit the electrical signal transmitted along the wire mesh.

18. The system of claim 17, wherein the tool is a running tool, a packer, a latch assembly, a latch cleaning assembly, a multilateral junction, a deflector, a whipstock, a dual bore deflector, a casing joint, a tubing joint, a window joint, a latch coupling, an alignment subassembly, a bushing, a casing orientation tool, a float shoe, a float collar, a liner hanger, the tool comprising an electrical device, a workover tool, a downhole tool, or an open hole anchor.

19. The system of claim 17, wherein the wellbore device is a valve, a sensor, a packer, a computer, a battery, a controller, a device comprising an electrical component, or a logic device.

20. The system of claim 17, wherein the wire mesh is disposed in at least one interior void of the tool, between an inner and outer wall of the tool, or along an exterior of the tool.

* * * * *